US008520359B1

(12) United States Patent
Nawaz

(10) Patent No.: US 8,520,359 B1
(45) Date of Patent: Aug. 27, 2013

(54) STUN GUN WITH KNUCKLE GUARD

(75) Inventor: Babar Nawaz, Orlando, FL (US)

(73) Assignee: Jaguar Imports, LLC, Orlando, FL (US)

( * ) Notice: Subject to any disclaimer, the term of this patent is extended or adjusted under 35 U.S.C. 154(b) by 0 days.

(21) Appl. No.: 13/366,583

(22) Filed: Feb. 6, 2012

(51) Int. Cl.
*H01T 23/00* (2006.01)

(52) U.S. Cl.
USPC ..... 361/232

(58) Field of Classification Search
USPC ..... 361/232
See application file for complete search history.

(56) References Cited

U.S. PATENT DOCUMENTS 6,635,975 B2 * 10/2003 Hsieh et al. ..... 307/326
D609,346 S * 2/2010 Yu ..... D24/168
2012/0206856 A1 * 8/2012 Norman ..... 361/232

* cited by examiner

*Primary Examiner* — Dharti Patel
(74) *Attorney, Agent, or Firm* — McKinney Law, PLLC

(57) ABSTRACT

A stun gun with a knuckle guard is disclosed. The stun gun is configured to fit and be held firmly within a palm of a user's hand. A knuckle guard is disposed on the stun gun and is configured to cover the user's knuckle when the stun gun is being gripped by the user's hand. In addition, the stun gun includes a trigger that is disposed on a front portion of the housing and is used to activate the stun gun by pushing down on the trigger with the user's finger. Electrodes are mounted above the knuckle guard and are adapted to discharge an electric shock when the trigger is activated. A rear portion of the stun gun also includes a pair of pointed projections that are adapted to be used to strike the assailant to cause injury.

18 Claims, 2 Drawing Sheets

FIG. 1
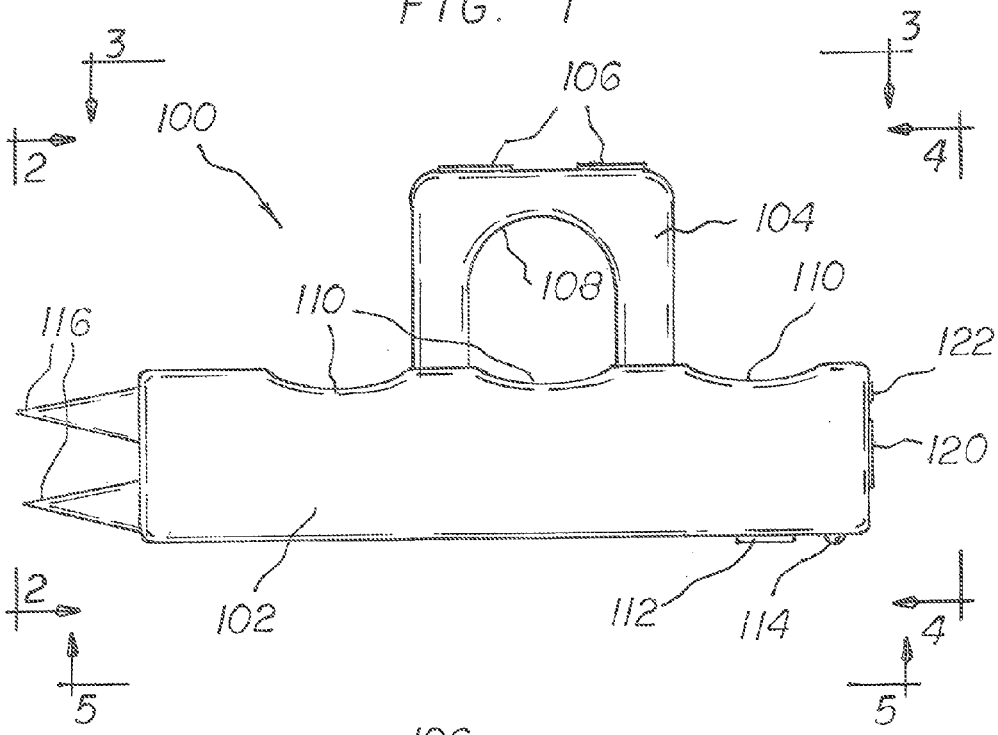
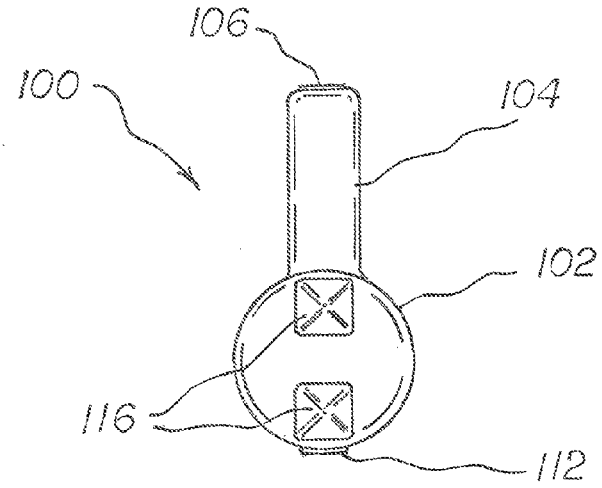
FIG. 2

FIG. 3
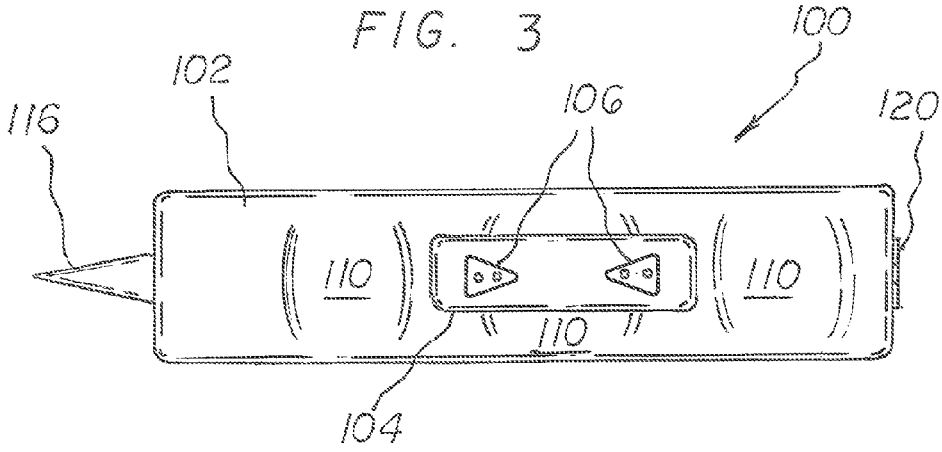
FIG. 4
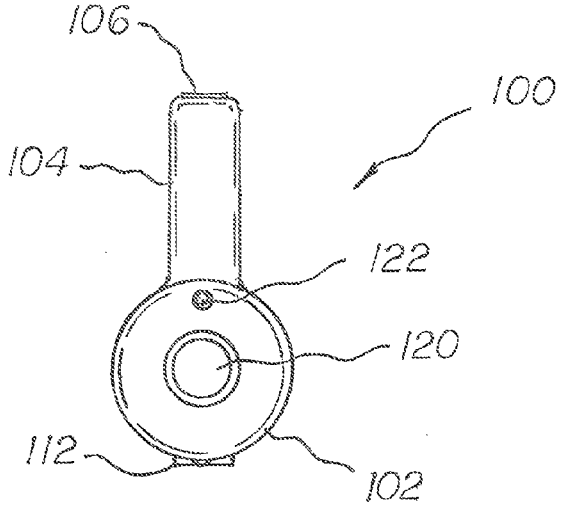
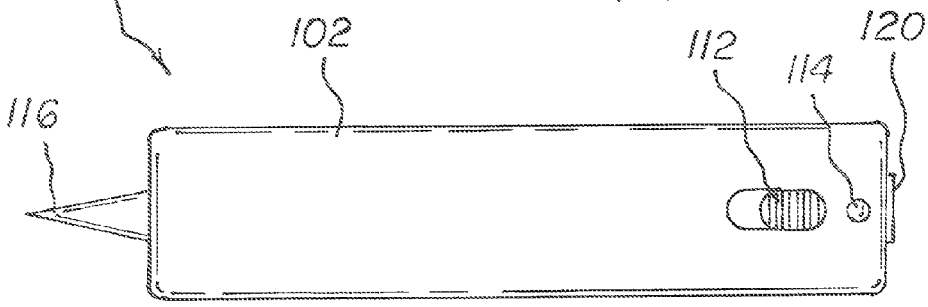
FIG. 5

STUN GUN WITH KNUCKLE GUARD

I. FIELD

The present invention relates generally to personal protection devices, and more specifically to a stun gun with a knuckle guard that is carried by a person to provide an electrical and paralyzing shock to an assailant.

II. DESCRIPTION OF RELATED ART

Stun guns use a high voltage and a low current electrical discharge to immobilize an assailant. The electrical discharge causes the assailant's muscles to uncontrollably spasm so that the assailant is temporarily paralyzed. The voltage of a stun gun typically ranges between 20,000 to 650,000 volts. Batteries serve as a power supply to electrical circuitry consisting of various electrical components. The circuitry includes a transformer that boosts the voltage in the circuit and reduces the amperage of the electrical current. A capacitor is used to build up and store an electrical charge before discharging the electrical shock through a pair of electrodes to the assailant.

A shortcoming of the prior art stun guns is that they may be dislodged from a user's hand easily when attempting to use in self-defense. Accordingly, what is needed is a stun gun that is easy to grip and to hold securely in a person's hand.

Another shortcoming of the prior art is that the stun gun may be needed in dark and desolate areas such as a parking lot at night, for example, making it difficult to orientate and activate the stun gun. Accordingly, a need exists in the art for an improved stun gun that can be quickly and easily positioned correctly and activated to stop a potential assailant.

Yet another shortcoming of the prior art stun guns is to provide another means to provide self defense in the event that the electrical discharge is ineffective against an assailant. Thus, a need exists in the art for an improved stun gun that provides an alternative means to stop an assailant that does not rely on electrical current or some type of deterrent spray.

It is, therefore, to the effective resolution of the aforementioned problems and shortcomings of the prior art that the present invention is directed.

However, in view of the prior art at the time the present invention was made, it was not obvious to those of ordinary skill in the pertinent art how the identified needs could be fulfilled.

III. SUMMARY

In a particular embodiment, a stun gun with a knuckle guard is disclosed. The stun gun is configured to fit and be held firmly within a palm of a user's hand and easily gripped with the user's fingers. A trigger is disposed on a front portion of the housing, where the trigger causes the stun gun to discharge an electric shock through electrodes mounted above the knuckle guard to stun an assailant. The knuckle guard is configured and placed on the stun gun to cover the user's middle finger (or other finger) when the stun gun is being gripped by the user's hand. The knuckle guard protects the user's finger and prevents the assailant from easily dislodging the stun gun from the user's hand. In addition, in a struggle with the assailant, the user can punch at the assailant while the user's finger can remain firmly on the trigger and continue to depress the trigger to repeatedly shock the assailant. Further, a rear portion of the housing includes a pair of pointed projections that can be used in a downward stabbing motion as further protection from an assailant if the electric shock is ineffective.

It is therefore an object of the present invention to provide for an improvement that overcomes the aforementioned inadequacies of the prior art and provides a significant contribution to the advancement of stun gun devices.

These and other important objects, advantages, and features of the invention will become clear as this description proceeds. The invention accordingly comprises the features of construction, combination of elements, and arrangement of parts that will be exemplified in the description set forth hereinafter.

Both the foregoing general description and the following detailed description are explanatory and are not restrictive of the invention. The accompanying drawings, which are incorporated in and constitute part of the specification, illustrate embodiments of the present invention and together with the general description, serve to explain principles of the present invention.

IV. BRIEF DESCRIPTION OF THE DRAWINGS

For a fuller understanding of the nature and objects of the invention, reference should be made to the following detailed description, taken in connection with the accompanying drawings, in which:

FIG. 1 is a right side elevational of a particular illustrative embodiment of a stun gun with a knuckle guard;

FIG. 2 is a rear view of the particular illustrative embodiment of the stun gun with the knuckle guard;

FIG. 3 is a top view of the particular illustrative embodiment of the stun gun with the knuckle guard;

FIG. 4 is a front view of the particular illustrative embodiment of the stun gun with the knuckle guard; and FIG. 5 is a bottom view of the particular illustrative embodiment of the stun gun with the knuckle guard.

V. DETAILED DESCRIPTION

Referring now to FIG. 1, a stun gun 100 is disclosed, which includes a housing 102 that contains the electronic components for the stun gun 100 to operate. FIG. 1 is a side view of the stun gun 100 showing the finger depressions 110 that are adapted to help the user's fingers grip the stun gun 100 without slipping. In addition, the location of the stun gun electrodes 106 being directly above the user's knuckles allows the user to easily apply the electrodes 106 to the assailant in an almost punching motion that is instinctively used in self defense. In the preferred embodiment, the housing 102 is generally cylindrical in shape so that it may be held firmly within the palm of a user's hand and comfortably gripped with the user's fingers. The side of the housing 102 may include several rounded finger depressions 110 that are adapted to help the user's fingers grip the housing 102 and to provide a comfortable grip. In addition, the finger depressions 110 assist the user in orientating the stun gun 100 by feel, which is beneficial when the user is under duress or in low visibility conditions.

A knuckle guard 104 is secured to a side of the housing 102 and is adapted to arch over and protect a user's knuckle when the user is gripping the housing 102. The interior edge 108 of the knuckle guard 104 is preferably arched and rounded over the user's knuckle to provide user comfort. The pair of electrodes 106 are secured to a top portion of the knuckle guard 104 and are in electrical communication with the electronic components of the stun gun 100. Accordingly, the user grips the housing 102 in a clenched fist fashion, and the knuckle guard 104 covers the middle finger knuckle of the user. The user can move the stun gun 100 in a natural punching motion in an attempt to shock an assailant in self defense and also use the knuckle guard 104 as a weapon to inflict damage on the assailant. Further, a bottom portion of the housing 102 includes a pair of pointed projections 116 that can be used in a downward stabbing motion as further protection from an assailant if the electric shock is ineffective.

FIG. 2 is a top view of the stun gun 100 showing the electrodes 106 that are in electrical communication with a transformer within the stun gun 100. The electrodes 106 have a high voltage difference between them and are each comprised of a plate of conducting metal positioned in the circuit with a gap between them. Since the electrodes 106 have a high voltage difference between them, when the stun gun 100 is activated by the trigger 120, this gap is closed by touching an assailant's body, the electrical pulses will try to move from one electrode to the other, thereby providing an intense electrical shock to the assailant. As explained above, the knuckle guard 104 is configured and placed on the stun gun housing 102 to receive the user's middle finger (or other finger) therein when the housing 102 is being gripped by the user's hand. The knuckle guard 104 protects the user's finger and prevents the assailant from easily dislodging the stun gun 100 from the user's hand. In addition, the knuckle guard 104 helps the user maintain a firm grip on the stun gun 100 in a struggle with the assailant so that the user can continue to depress the trigger 120 to repeatedly shock (or attempt to shock) the assailant. The knuckle guard 104 also helps the user to orientate the stun gun 100 in low light conditions or in a panic situation.

Referring now to FIG. 3, when a trigger 120 on a front portion of the housing is depressed, a discharge circuitry for the stun gun 100 is activated using a circuit board to cause the power supply to energize a transformer within the housing 102. A capacitor in turn is charged by the transformer until a predetermined discharge point causes the capacitor to discharge through the transformer that steps up the voltage and produces a high voltage across the electrodes 106. This generates a visible spark across the electrodes 106 and a loud popping sound.

A front view of the stun gun 100 is shown in FIG. 4 illustrating a rechargeable plug or port 122 that may be used to recharge the power supply of the stun gun 100. In use, household AC current may be used to recharge the power supply of the stun gun 100. In a particular illustrative embodiment, the power supply comprises rechargeable batteries. In another particular illustrative embodiment, the power supply may be non-rechargeable batteries. The port 122 is in electrical communication with the power supply for recharging with houshold AC current without having to remove the power supply from the stun gun 100. As best illustrated by FIG. 4, the trigger 120 is located on a front portion of the housing 102 and when depressed by the user's thumb causes an electrical shock to be discharged between the electrodes 106 using electronic components of the stun gun 100.

FIG. 5 is a bottom view of the stun gun 100 showing the on/off switch 112. The switch 112 may be located in the area on the stun gun 100 where the user's thumb is placed when gripping the housing 102. The stun gun 100 is adapted for both a left hand or right hand user. An indicator light 114 indicates to the user when the stun gun 100 is turned on and armed. The on/off switch 112 may be placed anywhere on the housing 102 but preferably the on/off switch 112 is placed on an opposing side of the housing 102 from the knuckle guard 104. Thus, when the user grips the housing 102, the on/off switch 112 is located where the user's thumb can easily move the switch 102 to the "on" position.

The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

It is also to be understood that the following specification and drawings are intended to cover all of the generic and specific features of the invention herein described, and all statements of the scope of the invention, which as a matter of language, might be said to fall there between. The particular embodiments disclosed above and in the drawings are illustrative only, as the invention may be modified and practiced in different but equivalent manners apparent to those skilled in the art having the benefit of the teachings herein. Furthermore, no limitations are intended to the details of construction or design herein shown. It is therefore evident that the particular embodiments disclosed above may be altered or modified and all such variations are considered within the scope and spirit of the invention.

What is claimed is:

1. A stun gun, the stun gun comprising:

a housing adapted to be grasped and held firmly within a palm of a user's hand;

a knuckle guard disposed on the stun gun and configured to arch over the user's knuckle when the stun gun is being gripped by the user's hand, wherein the knuckle guard protects the user's knuckle and prevents an assailant from easily dislodging the stun gun from the user's hand;

a trigger disposed on a top portion of the housing outside of the knuckle guard and configured to be activated by pushing down on the trigger with the user's finger to shock the assailant;

electrodes mounted above the knuckle guard and adapted to discharge an electric shock when the trigger is activated; and a pair of pointed projections disposed on a bottom portion of the housing configured to strike the assailant to cause injury separate from the electrodes.

2. The stun gun of claim 1, wherein the housing further comprising finger depressions that are adapted to help the user's fingers grip the stun gun without slipping.

3. The stun gun of claim 2, further comprising an on/off switch to arm the stun gun, wherein the on/off switch is adapted to be placed on either or both sides of the housing.

4. The stun gun of claim 3, further comprising discharge circuitry that is activated when the trigger is depressed, wherein a power supply energizes a transformer and a capacitor in turn is charged by the transformer until a predetermined discharge point causes the capacitor to discharge through the transformer that steps up the voltage and produces a high voltage across the electrodes.

5. The stun gun of claim 4, further comprising a rechargeable port to recharge the power supply of the stun gun, wherein household AC current is used to recharge the power supply.

6. The stun gun of claim 5, wherein the power supply comprises rechargeable batteries or non-rechargeable batteries.

7. The stun gun of claim 6, wherein the trigger is adapted to be pressed by the user's thumb.

8. The stun gun of claim 7, further comprising an indicator light to indicate to the user when the stun gun is turned on and armed.

9. The stun gun of claim 8, wherein the electrodes have a high voltage difference between them and are each comprised of a plate of conducting metal positioned in the circuit with a gap between them, wherein when the stun gun is activated by the trigger, the gap is closed by touching an assailant's body as electrical pulses move from one electrode to the other to provide an intense electrical shock to the assailant.

10. The stun gun of claim 9, wherein the housing is cylindrical in shape and adapted to be easily gripped by the user's hand.

11. The stun gun of claim 10, wherein the location of the electrodes directly above the user's knuckles allows the user to easily apply the electrodes to the assailant in a punching motion.

12. A stun gun, the stun gun comprising:

a housing adapted to be grasped and held firmly within a palm of a user's hand;

a knuckle guard projecting from a side of the housing and configured to protect a user's knuckle of a finger placed therein;

a trigger located outside the knuckle guard, wherein the trigger is configured to discharge an electric shock through electrodes when depressed; and a pair of pointed projections disposed on the housing configured to strike the assailant to cause injury separate from the electrodes.

13. The stun gun of claim 12, wherein the electrodes are mounted directly above the knuckle guard to stun an assailant.

14. The stun gun of claim 13, wherein the knuckle having a concave portion adapted to cover the user's knuckle.

15. The stun gun of claim 14, further comprising discharge circuitry that is activated when the trigger is depressed, wherein a power supply energizes a transformer and a capacitor in turn is charged by the transformer until a predetermined discharge point causes the capacitor to discharge through the transformer that steps up the voltage and produces a high voltage across the electrodes.

16. The stun gun of claim 15, further comprising a rechargeable plug to recharge the power supply of the stun gun, wherein household AC current is used to recharge the power supply.

17. The stun gun of claim 16, wherein the power supply comprises rechargeable batteries or non-rechargeable batteries.

18. A stun gun, the stun gun comprising:

a housing;

a knuckle guard configured to receive a user's finger therein and cover the user's knuckle;

a trigger located at a top portion of the housing outside the knuckle guard;

electrodes mounted directly above the knuckle guard to stun an assailant; and a pair of pointed projections adapted to be used to strike the assailant to cause injury separate from the electrodes.

* * * * *